US005535459A

United States Patent [19]

DiMatteo et al.

[11] Patent Number: 5,535,459

[45] Date of Patent: Jul. 16, 1996

[54] PATIENT TRANSFER SEAT

[75] Inventors: Paul DiMatteo, Dix Hills; Charles Chubb, Brookville; Robert Nichols, Rocky Point, all of N.Y.

[73] Assignee: Nova Technologies, Inc., Hauppauge, N.Y.

[21] Appl. No.: 183,094

[22] Filed: Jan. 18, 1994

Related U.S. Application Data

[63] Continuation-in-part of Ser. No. 908,988, Jul. 6, 1992, Pat. No. 5,319,813.

[51] Int. Cl.[6] ..... A61G 7/10

[52] U.S. Cl. ..... 5/88.1; 5/600; 5/86.1; 5/81.1 R; 297/DIG. 10

[58] Field of Search ..... 5/81.1, 83.1, 86.1, 5/89.1, 600; 297/250.1, DIG. 10

[56] References Cited

U.S. PATENT DOCUMENTS

| | | | |
|---|---|---|---|
| 2,539,346 | 1/1951 | Feist et al. . | |
| 3,999,227 | 12/1976 | Ingemansson | 5/83.1 |
| 4,262,375 | 5/1981 | Lilienthal | 5/81 B |
| 4,737,997 | 4/1988 | Lamson | 5/81.1 |
| 4,819,283 | 12/1986 | DiMatteo et al. | 5/81 R |
| 4,941,220 | 7/1990 | DiMatteo et al. | 5/81 R |

FOREIGN PATENT DOCUMENTS

| | | | |
|---|---|---|---|
| 172296 | 2/1986 | European Pat. Off. | 5/81.1 |
| 2610517 | 12/1988 | France | A61G 7/10 |
| 584542 | 2/1977 | Switzerland | A61G 7/10 |

*Primary Examiner*—Michael F. Trettel

*Attorney, Agent, or Firm*—Patterson, Belknap Webb & Tyler

[57] ABSTRACT

A transfer seat assembly is disclosed for use in conjunction with a hospital bed to transfer a patient from the bed to a location remote therefrom. The transfer seat assembly includes a frame portion and a removable seating portion. A method of transferring a patient from a reclined position on the bed to a seated position remote from the bed upon the transfer seat assembly is also disclosed.

27 Claims, 15 Drawing Sheets

PATIENT TRANSFER SEAT

BACKGROUND OF THE INVENTION

This is a continuation-in-part of pending application U.S. Ser. No. 07/908,988 filed on Jul. 6, 1992, now U.S. Pat. No. 5,319,813 which is hereby incorporated by reference.

1. Field of the Invention

This invention relates to a patient transfer system, and more particularly, to a transfer seat assembly for use in association with a hospital bed and a method of transferring a patient from the bed to a location remote therefrom.

2. Description of Related Art

The process of transferring a patient from a reclined position on a hospital bed to a wheelchair or toilet often involves the aid of more than one person. The task frequently requires considerable strength and is occasionally a source of injury to the patient, nurse, or attendant. These problems can be factors that cause a person to remain hospitalized or moved to a nursing home, rather than being cared for at home.

Accordingly, it is an object of the subject invention to provide a patient transfer seat configured to transfer a patient from a reclined position on a suitably equipped bed to a seated position at the foot of the bed with minimal effort on the part of an attendant.

It is another object of the subject invention to provide a patient transfer seat for use in association with a hospital bed upon which a seated patient may be transferred to a location remote from the hospital bed, especially onto a wheelchair.

SUMMARY OF THE INVENTION

A transfer seat assembly is provided for use in conjunction with a hospital bed to transport a patient from the bed to a location remote therefrom. The transfer seat assembly preferably comprises a frame portion including a pair of parallel support legs and a removable seating portion including a pair of parallel pockets for receiving the support legs.

The transfer seat assembly may be pivotably connected to the hospital bed by a suspension linkage or it may be supported on an independent transport vehicle. Alternatively, the transfer seat assembly may be detachably mounted to the hospital bed.

In operation, the transfer seat assembly is utilized by conveying the patient in a reclined position at least partially onto the transfer seat assembly; elevating at least a portion of the mattress of the bed to raise the patient into a seated position within the transfer seat assembly. Then, the transfer seat assembly is moved toward a supporting surface remote from the bed such as, for example, a wheelchair. Subsequently, the transfer seat assembly is transferred onto the supporting surface and the frame portion of the assembly is removed from the seating portion thereof.

BRIEF DESCRIPTION OF THE DRAWINGS

Preferred embodiments of the patient transfer system of the subject invention will be described in detail hereinbelow with reference to the drawings wherein.

BRIEF DESCRIPTION OF THE PREFERRED EMBODIMENTS

Figure 1:
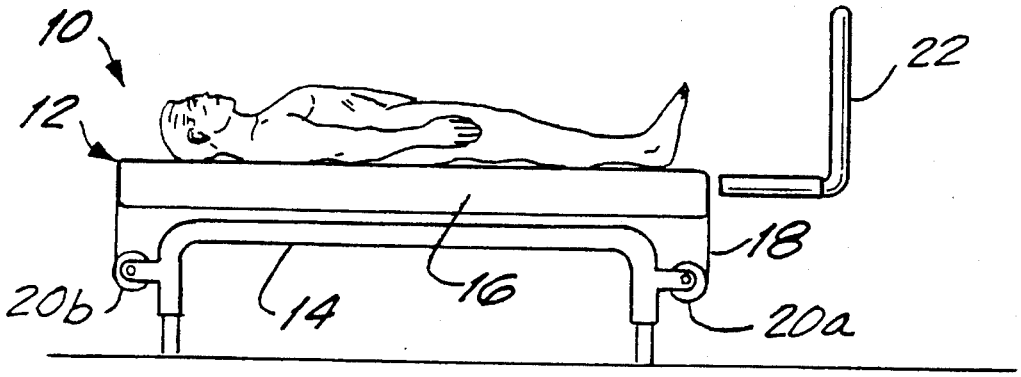
FIG. 1 is a side elevational view of the patient transfer system of the subject invention with a patient positioned on the hospital bed in a reclined position and the transfer seat assembly positioned at the foot of the bed.

Turning now to the drawings wherein like reference numerals indicate similar structural elements a patient transfer system constructed in accordance with a preferred embodiment of the subject invention is illustrated and is designated generally by reference numeral 10. In FIG. 1, the patient transfer system 10 comprises a hospital bed 12 which includes a frame 14 and a mattress 16 supported upon the frame 14. Hospital bed 12 further comprises a transport sheet 18 of the type which is described in commonly assigned U.S. Pat. No. 4,819,283, the disclosure of which is herein incorporated by reference.

Transport sheet 18 is adapted and configured to move a reclined patient longitudinally across mattress 16 and includes a roller arrangement for effectuating such movement. The roller arrangement includes a front roller 20*a* and a rear roller 20*b* about which the transport sheet 18 is wound. Electric motors or hand cranks may be provided to drive the two rollers 20*a* and 20*b* to wind transport sheet 18 on one roller while allowing it to unwind from the other so as to move the sheet and thereby transport a reclining person thereon.

Figure 2:
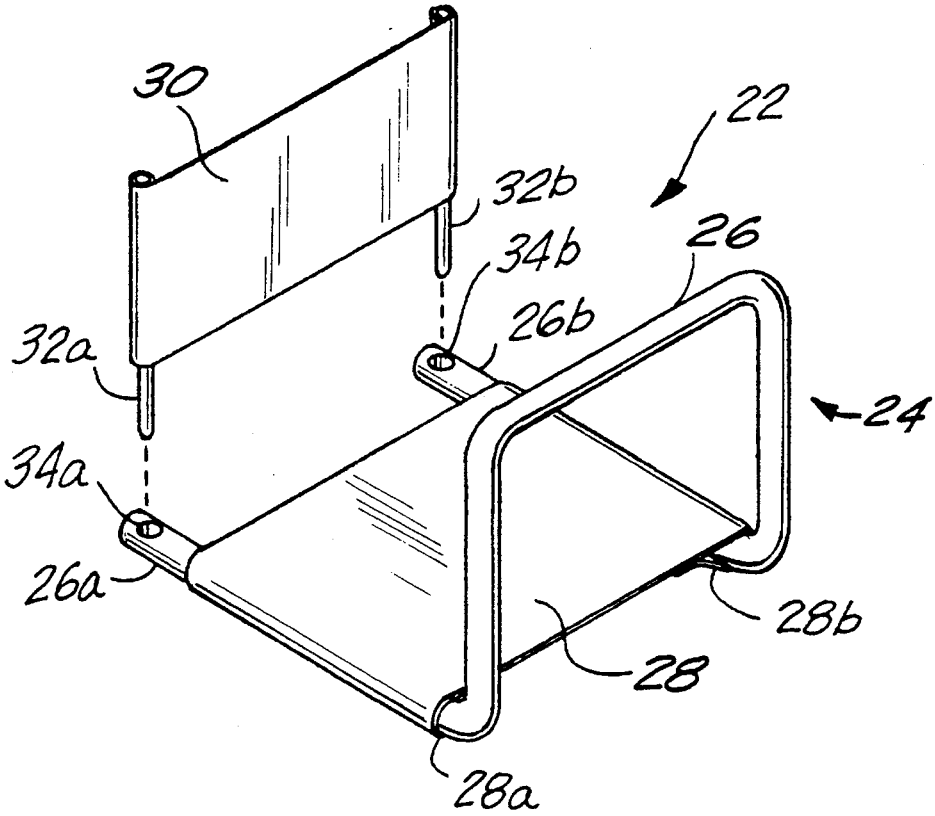
FIG. 2 is a perspective view with parts separated for convenience of illustration of a transfer seat assembly constructed in accordance with a preferred embodiment of the subject invention.

The patient transfer system 10 of the subject invention further comprises a transfer seat assembly 22 which is supported at the foot of bed frame 14. The transfer seat assembly 22 is adapted and configured to provide an intermediate surface upon which the patient may be supported before being transferred to a wheelchair or toilet. As best seen in FIG. 2, the transfer seat assembly 22 includes a seat frame 24 having a generally U-shaped structural portion 26 from which extends a pair of parallel support legs 26*a* and 26*b*, and a flexible seating surface 28. Seating surface 28 is preferably formed of a woven material although other materials of construction are envisioned, such as, for example, plastic materials. Seating surface 28 may also include a cushion for patient comfort. A pair of parallel side pockets 28*a* and 28*b* are provided in seating surface 28 and are dimensioned and configured to releasably receive the parallel support legs 26*a* and 26*b* of seat frame 24.

Transfer seat assembly 22 also includes a detachable backrest 30 which has a pair of spaced apart set pins 32*a* and 32*b* dimensioned and configured to engage a pair of correspondingly dimensioned apertures 34*a* and 34*b* formed in the support legs 26*a* and 26*b* of seat frame 24. The backrest 30 is provided to prevent the seating surface 28 from slipping off of the seat frame 24 when the patient is transferred onto the transfer seat 22 by the transport sheet 18 as well as providing added support for the patient.

Figure 3:
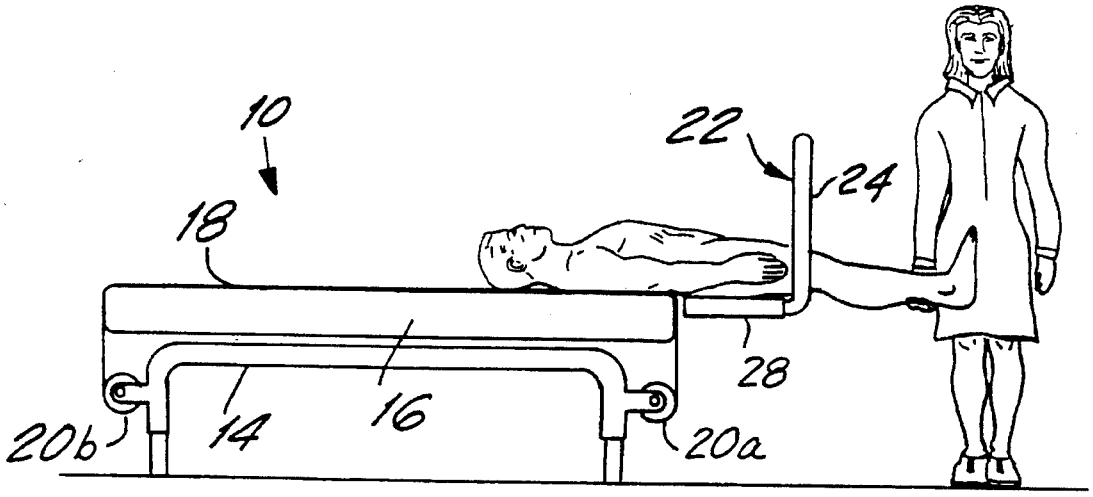
FIG. 3 is a side elevational view of the patient transfer system of FIG. 1 with the patient transferred partially onto the transfer seat as an attendant supports the patient's legs.
Figure 4:
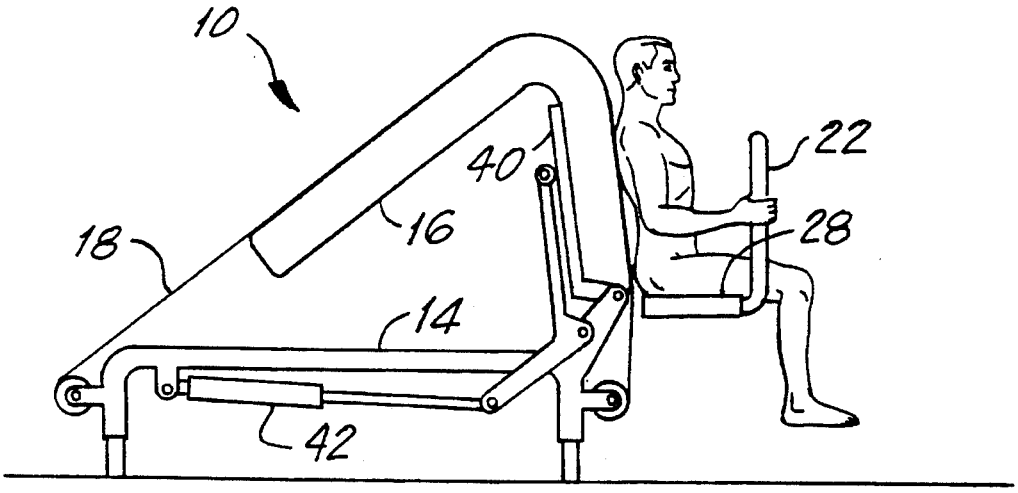
FIG. 4 is a side elevational view of the patient transfer system of FIG. 1 with a portion of the mattress elevated into an angled orientation to move the patient into a seated position on the transfer seat.
Figure 5:
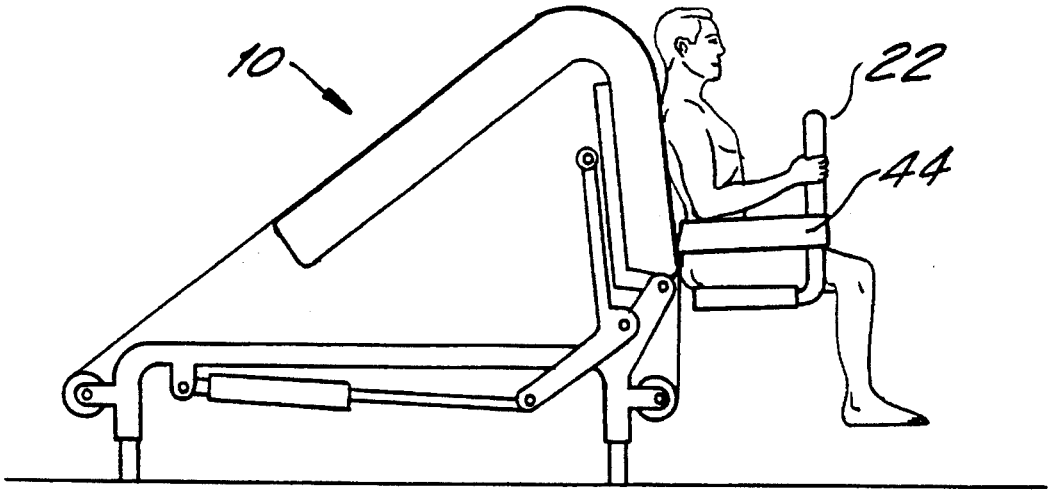
FIG. 5 is a side elevational view of the patient transfer system of FIG. 1 with the patient seated in the transfer seat assembly positioned at the foot of the hospital bed and secured therein with a waist strap.

In use, as illustrated in FIGS. 3–5, the transport sheet 18 is operated to move the patient at least partially onto the transfer seat assembly 22 such that the patient's buttocks are supported upon the seating surface 28. At such a time, an attendant positioned adjacent the transfer seat assembly 22 must support the weight of the patient's legs. Thereafter, as illustrated in FIG. 4, a portion of mattress 16 is elevated by a mattress lift member 40 which is pushed up by a link 17 pivoted on the bed frame 14 and pulled by an actuation mechanism such as linear actuator 42. Other actuation mechanisms may be used to raise mattress lift member 40 such as, for example, a manually operated pulley assembly. A mattress lift assembly such as that which is utilized in the subject invention is described, for example, in commonly assigned U.S. Pat. No. 4,941,220, the disclosure of which is herein incorporated by reference. In operation, the mattress lift member 40 serves to elevate the patient from a reclined position upon mattress 16 to a seated position within the transfer seat assembly 22. As illustrated in FIG. 5, a strap 44 may also be provided for placement about the patient's torso to secure the patient within the transfer seat assembly 22 during transport to an adjacent wheelchair.

Figure 6:
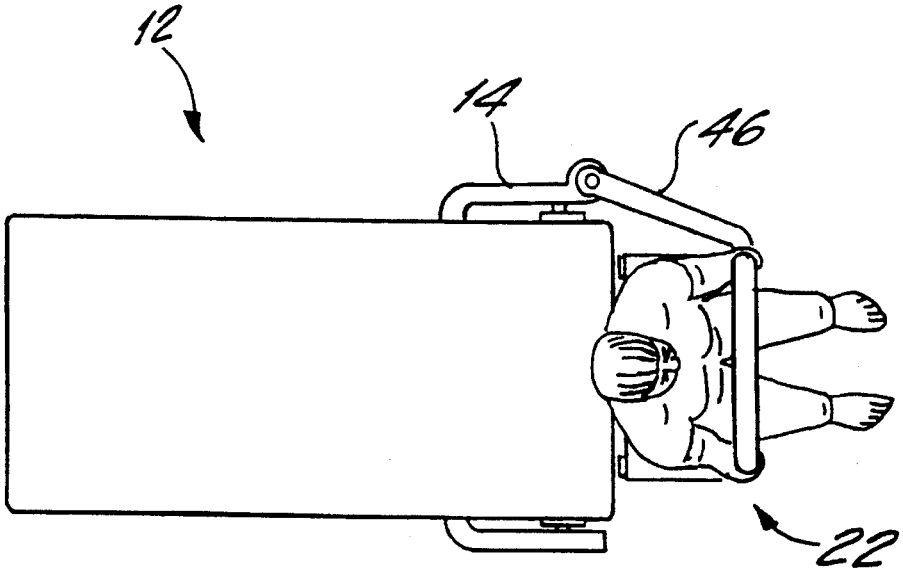
FIG. 6 is a top plan view of the patient transfer system of FIG. 1 with the patient seated in the transfer seat positioned at the foot of the hospital bed.
Figure 7:
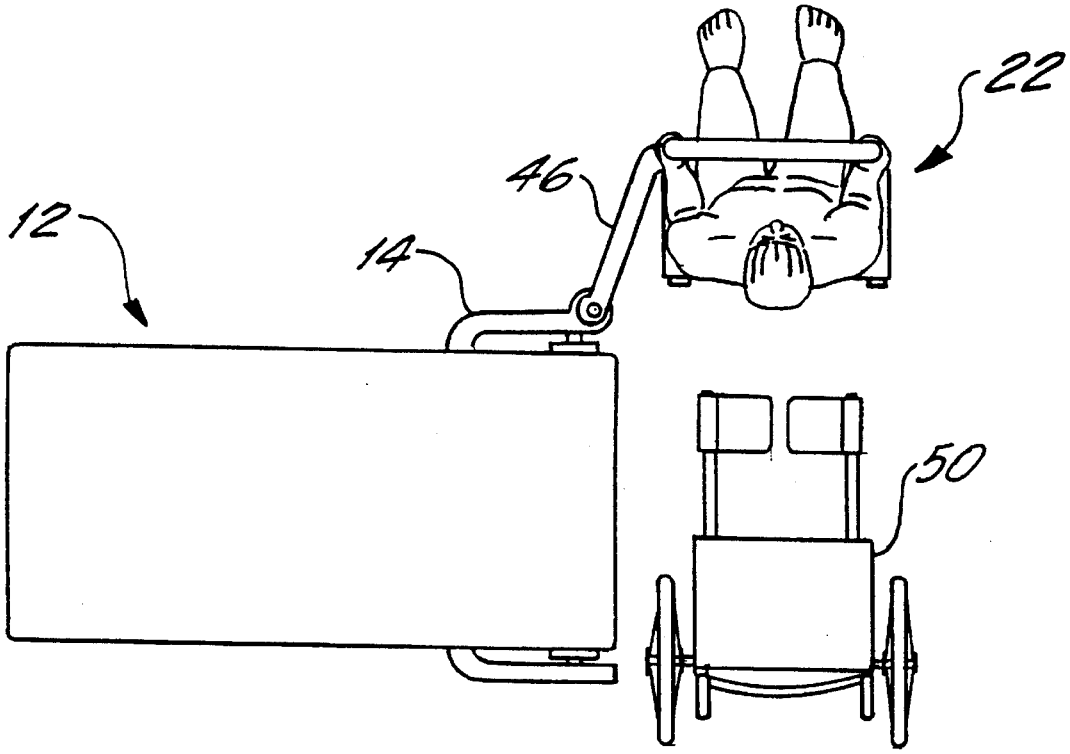
FIG. 7 is a top plan view of the patient transfer system of the subject invention with the transfer seat pivoted into a transferring position for movement into an adjacent wheelchair.
Figure 8A:
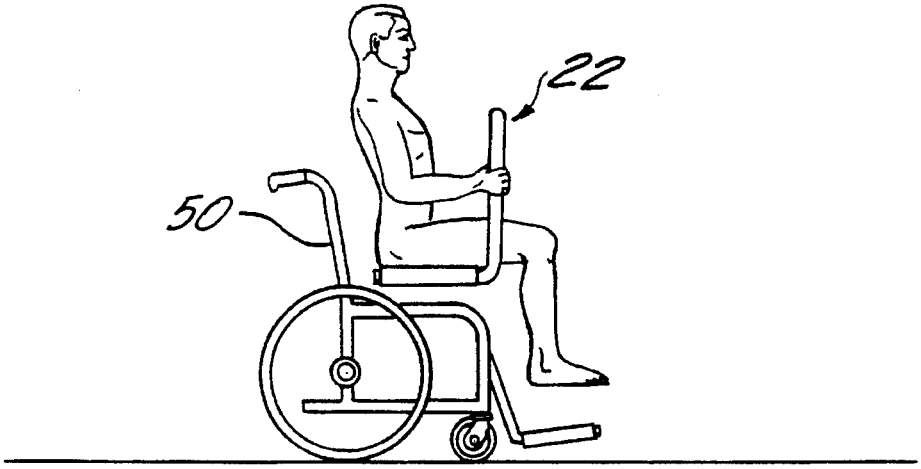
FIGS. 8A–8C illustrate the patient being transferred onto a wheelchair and the subsequent removal of the transfer seat frame from the seating surface of the transfer assembly.
Figure 8B:
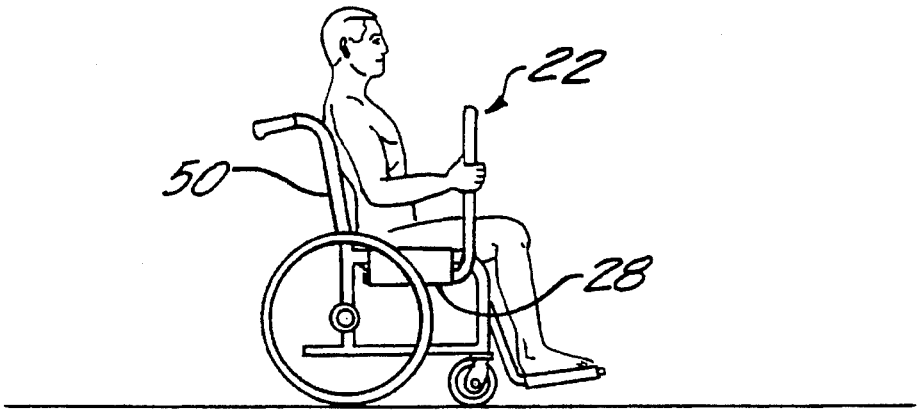
Figure 8C:
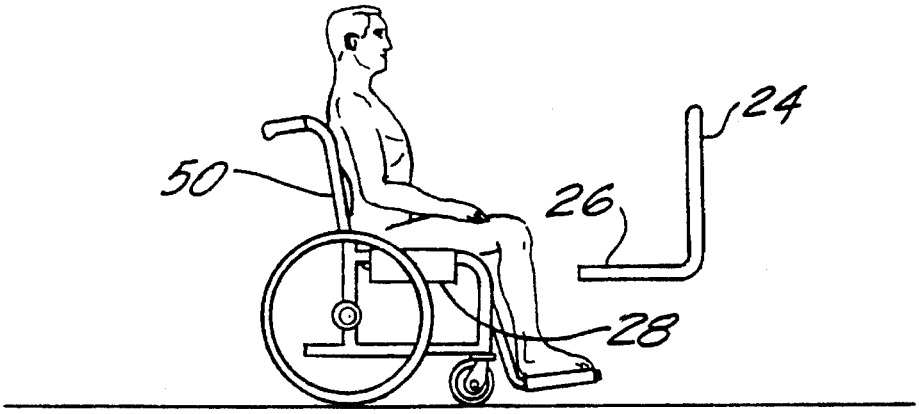

Referring to FIGS. 6 and 7, the transfer seat assembly 22 is mounted on the bed frame 14 through a pivoting linkage 46 which is configured to facilitate guided movement of the transfer seat assembly 22 with respect to the bed frame 14. In addition, the bed 12 has an elevator mechanism 48, not shown, whereby the bed frame 14 and the attached transfer seat assembly 22 can be raised and lowered. To transfer the patient from the bed 10 to a wheelchair, for example, the transfer seat assembly 22 is rotated 90° from the position illustrated in FIG. 6, to the position which is illustrated in FIG. 7. Then, the wheelchair 50 is moved into a position directly below the transfer seat assembly 22, as shown in FIG. 8A. Subsequently, as illustrated in FIG. 8B, transfer seat assembly 22 is lowered by the elevator mechanism 48 into the wheelchair 50. As shown in FIG. 8C, the transfer seat frame 24 may be detached from the seating surface 28 by siding the support legs 26 out of the side pockets 28 of seating surface 28. Thereupon, the patient may be transported to a location remote from the hospital bed 12.

Turning now to FIGS. 9–15, there is illustrated another patient transfer system constructed in accordance with a preferred embodiment of the subject invention and designated generally by reference numeral 100. Patient transfer system 100 is constructed much like the patient transfer system 10 described previously hereinabove with the addition of a leg lift assembly 110 which is intended to eliminate the necessity of having an attendant support the weight of the patient's legs when the patient is moved onto the transfer seat assembly 122 by the transport sheet 118.

Figure 9:
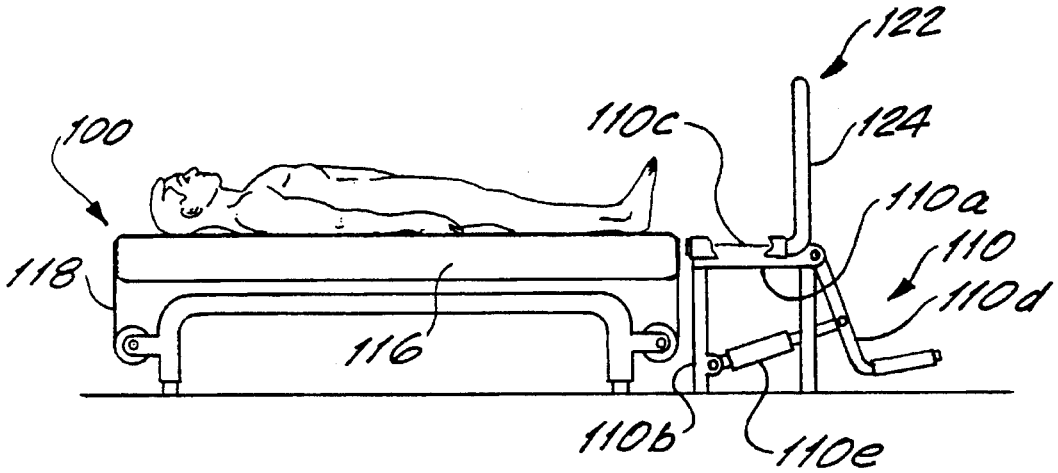
FIG. 9 is a side elevational view of another patient transfer system constructed in accordance with a preferred embodiment of the subject invention which incorporates a leg lift assembly.

As illustrated in FIG. 9, the leg lift assembly 110 includes a base structure 110*a* having a plurality of legs 110*b* and a support surface 110*c* upon which the transfer seat assembly 122 with frame 124 supported. The leg lift assembly 110 also includes a pivoting platform 110*d* which is adapted and configured to move from a generally vertical position shown in FIG. 9, through a series of angularly inclined positions illustrated in FIGS. 10–12. The platform 110*d* is pivoted into position by means of a linear actuator 110*e*, although other mechanisms for raising the platform 110*d* are also envisioned and are within the scope of the subject invention.

Figure 10:
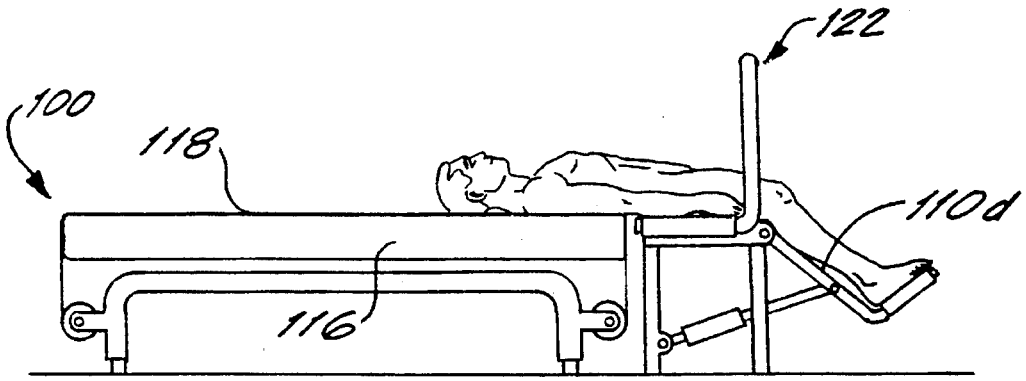
FIG. 10 is a side elevational view of the patient transfer system of FIG. 9 with the patient transferred partially onto the transfer seat and the leg lift assembly partially articulated into an angled orientation.
Figure 11:
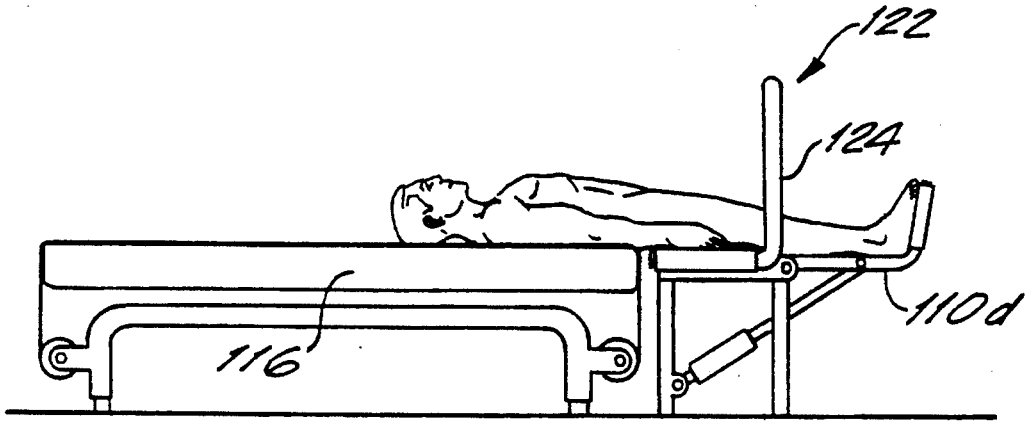
FIG. 11 is a side elevational view of the patient transfer system of FIG. 9 with the leg lift assembly articulated into a horizontal position in alignment with the seating surface of the transfer seat.
Figure 12:
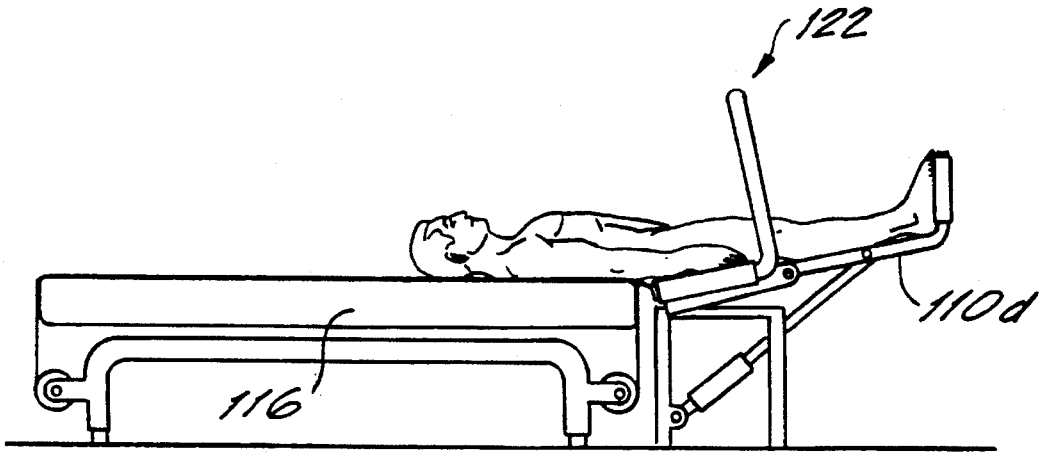
FIG. 12 is a side elevational view of the patient transfer system of FIG. 9 with the leg lift assembly articulated into an angled position above the plane of the seating surface of the transfer seat.

To facilitate transfer onto the transfer seat assembly 122 by transport sheet 118, platform 110*d* may be pivoted into a desired angular position, as shown, for example in FIG. 10. Once positioned on the transfer seat assembly 122, the patient's legs may thereupon be lifted into a horizontal position shown in FIG. 11, or raised above the plane of mattress 116 as shown in FIG. 12, depending upon the personal needs and physical constraints of the patient, to facilitate transfer back to the bed, or for comfort.

Figure 13:
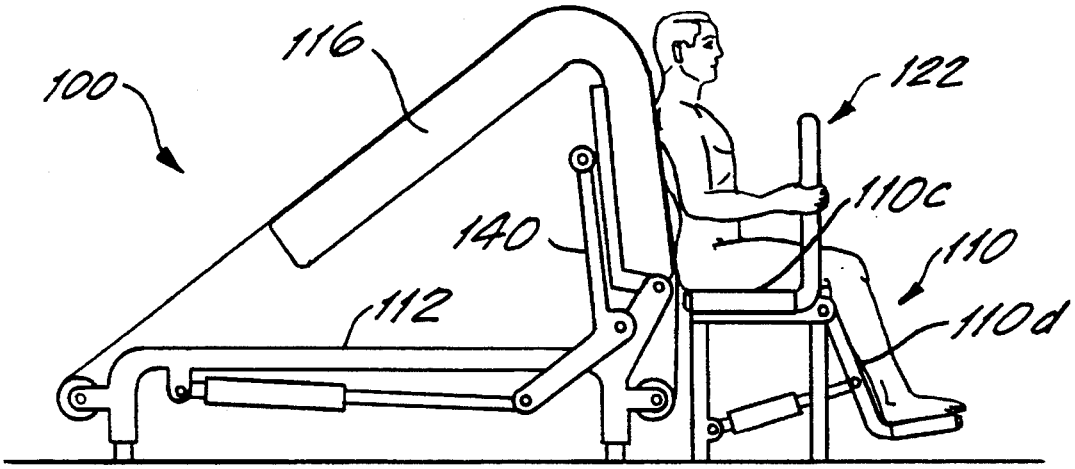
FIG. 13 is a side elevational view of the patient transfer system of FIG. 9 with the patient in a seated position on the transfer seat with the leg lift assembly articulated into a vertical position.
Figure 14:
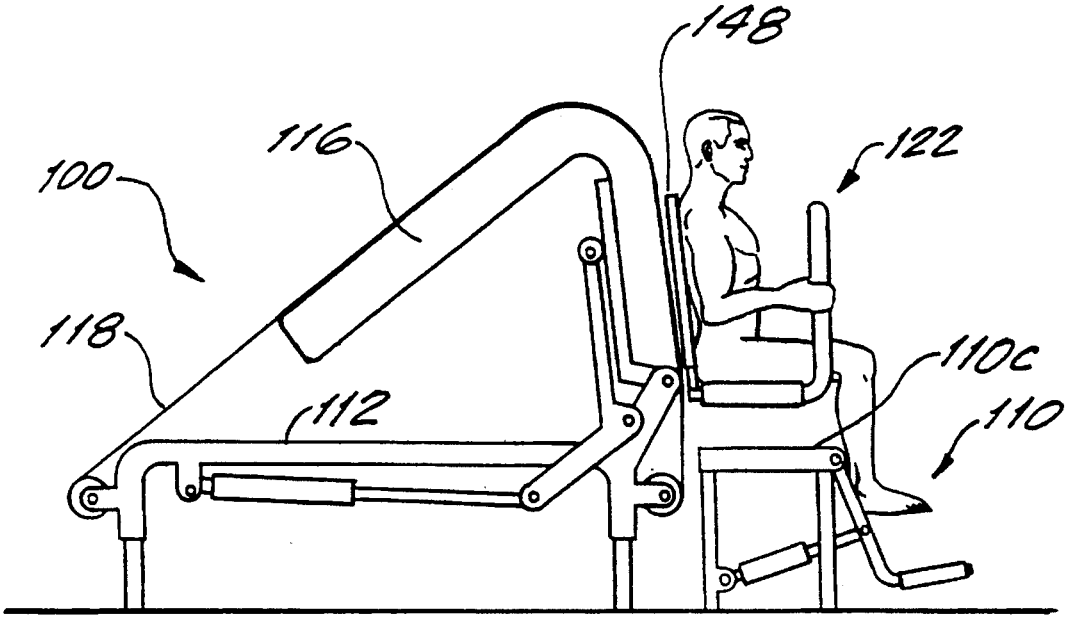
FIG. 14 is a side elevational view of the patient transfer system of FIG. 9 with the transfer seat lifted into a position above the leg lift assembly.
Figure 15:
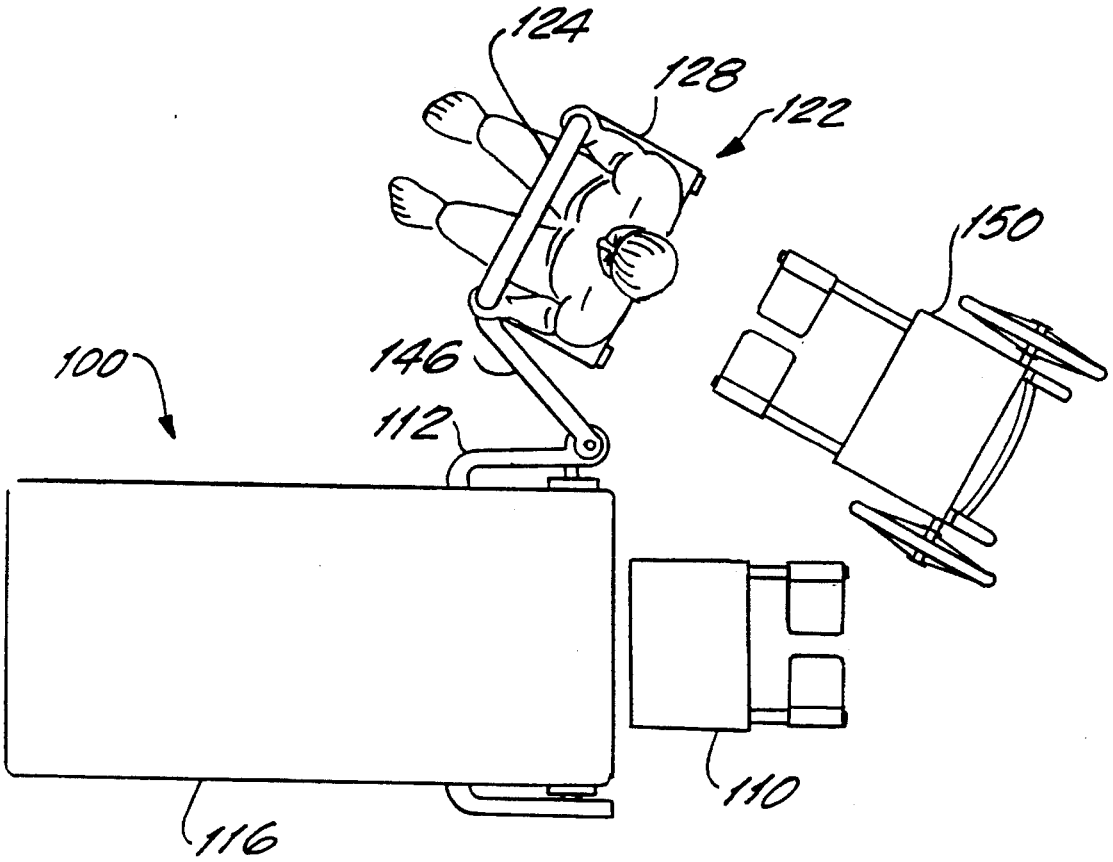
FIG. 15 is a top plan view of the patient transfer system of FIG. 9 with the transfer seat pivoted into a transferring position for movement to an adjacent wheelchair.

Once the patient has been moved into the transfer seat assembly 122, the platform 110*d* may be lowered into a vertical position and the mattress lift member 140 may be operated to elevate or raise the patient from a reclined position to a seated position, as illustrated in FIG. 13. Then, the transfer seat assembly 122 may be lifted above the support surface 110*c* of leg lift assembly 110 by the elevator mechanism not shown, by which the bed frame 112 is raised and lowered. Then, as shown in FIG. 14, a backrest 148, similar to backrest 30 in FIG. 2, can be inserted into the transfer seat assembly 122. As shown in FIG. 15, the transfer seat assembly 122 may then be moved away from the leg lift assembly 110 by pivoting the transport seat linkage 146 which is pivotally connected to and supported by the bedframe 112. At such a time, a wheelchair 150 may be positioned below the transfer seat assembly 122, and the transfer seat assembly 122 may be lowered onto the wheelchair 150 (see FIG. 15), as shown for embodiment 100 in FIGS. 8A, 8B, and 8C.

Figure 16:
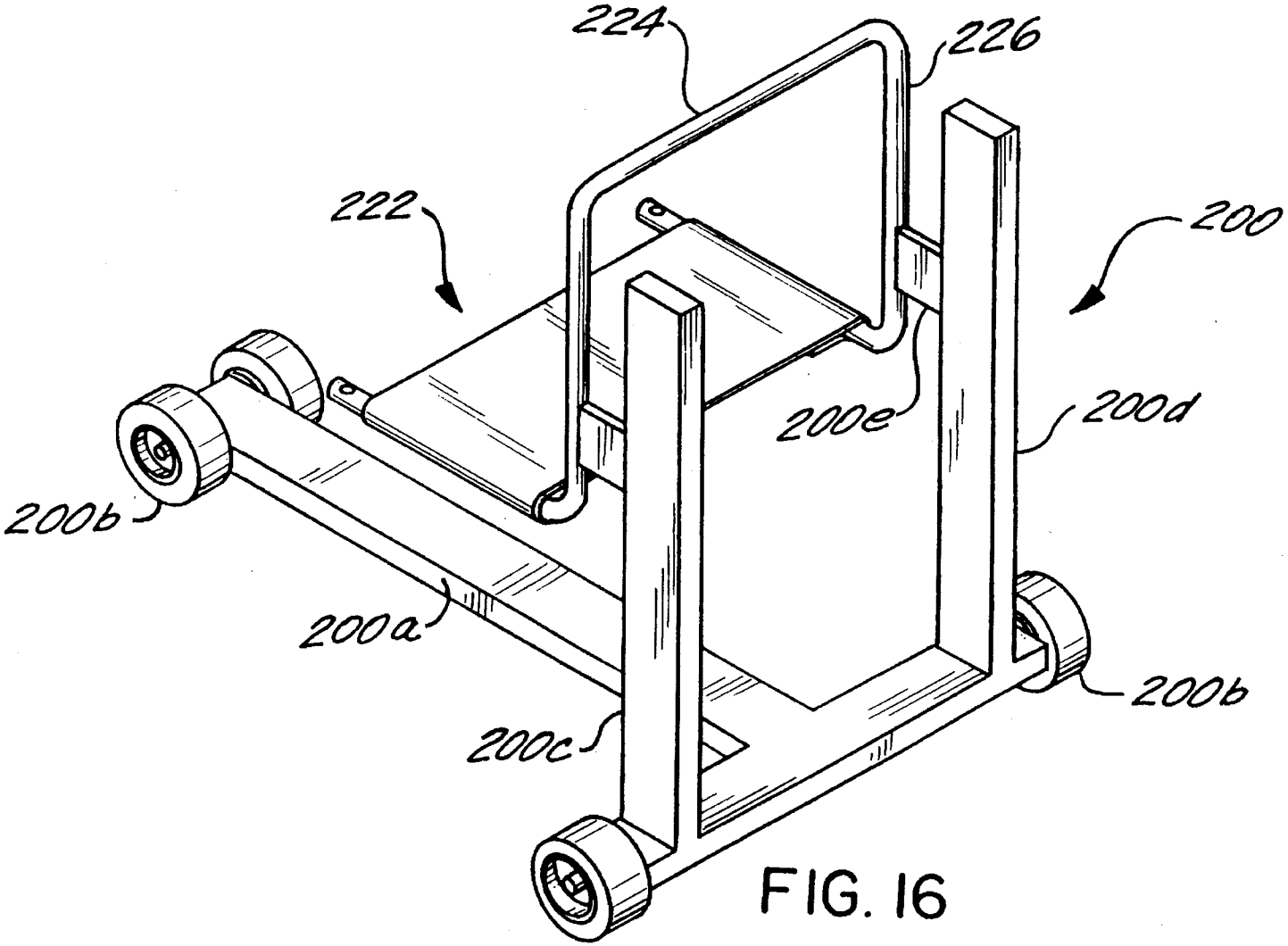
FIG. 16 is a perspective view of the transfer seat of the subject invention disposed on an independent transport vehicle.

Referring to FIG. 16, there is illustrated an independent transport vehicle 200 which is adapted and configured to transport the patient transfer seat assembly 222 between desired locations. Transport vehicle 200 includes a base 200*a* having a plurality of wheels 200*b* for facilitating movement of the transport vehicle 200 across a supporting surface. A pair of upstanding stantions 200*c* and 200*d* extend from the base 200*a* and include brackets 200*e* for mounting the U-shaped structural portion 226 of the transfer seat frame 224. Mounting brackets 200*e* are adapted and configured to be raised and lowered by elevating mechanisms within the stantions 200*c* and 200*d* to selectively elevate the transfer seat assembly 222 to a desired position.

Figure 17:
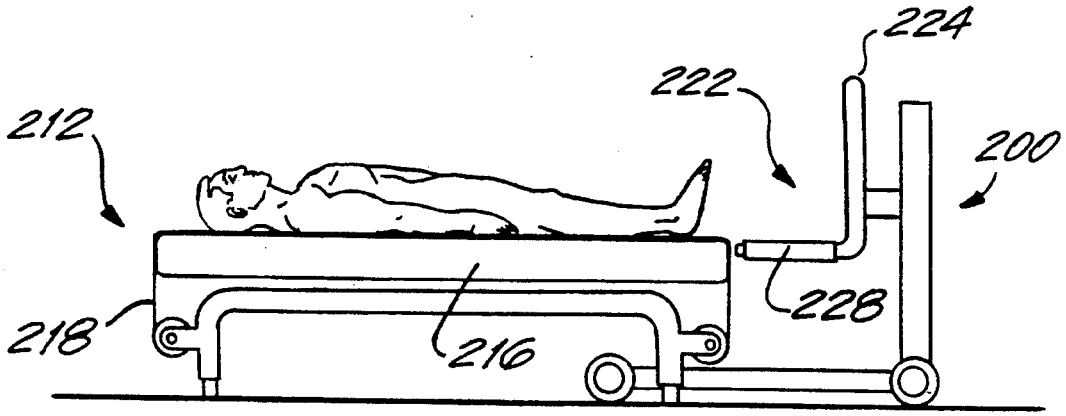
FIG. 17 is a side elevational view of a patient transfer system which incorporates the transport vehicle illustrated in FIG. 16.
Figure 18:
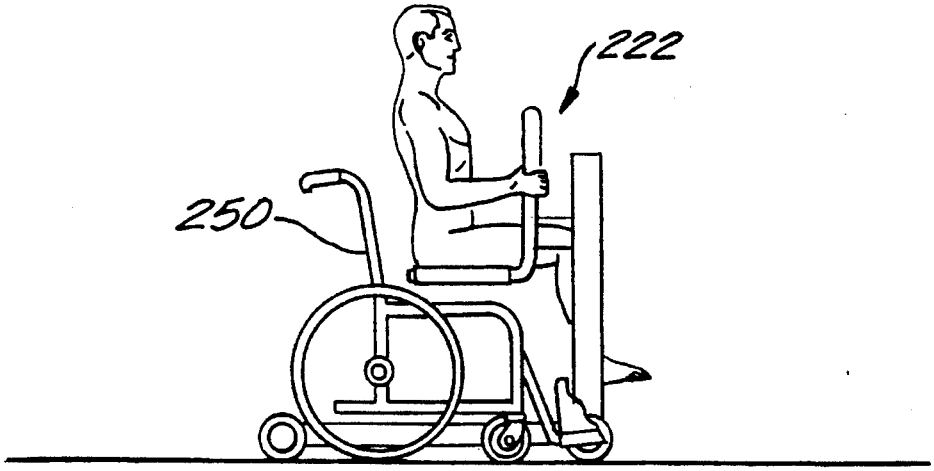
FIG. 18 is a side elevational view of the transport vehicle of FIG. 16 with the patient positioned in the transfer seat above an adjacent wheelchair.

As shown in FIG. 17, when the transport vehicle 200 is positioned adjacent the hospital bed 212, the seating surface 228 is in approximate alignment with the plane of the transport sheet 218 and mattress 216 to facilitate reception of the patient during a transfer procedure. Once the patient has been moved onto the transfer seat assembly 222 and raised to a seated position, the transport vehicle 200 may be guided toward a wheelchair 250, for example, whereupon the transfer seat assembly 222 may be lowered onto the wheelchair 250 (see FIG. 18), in a similar fashion as illustrated in FIGS. 8A, 8B and 8C.

Figure 19:
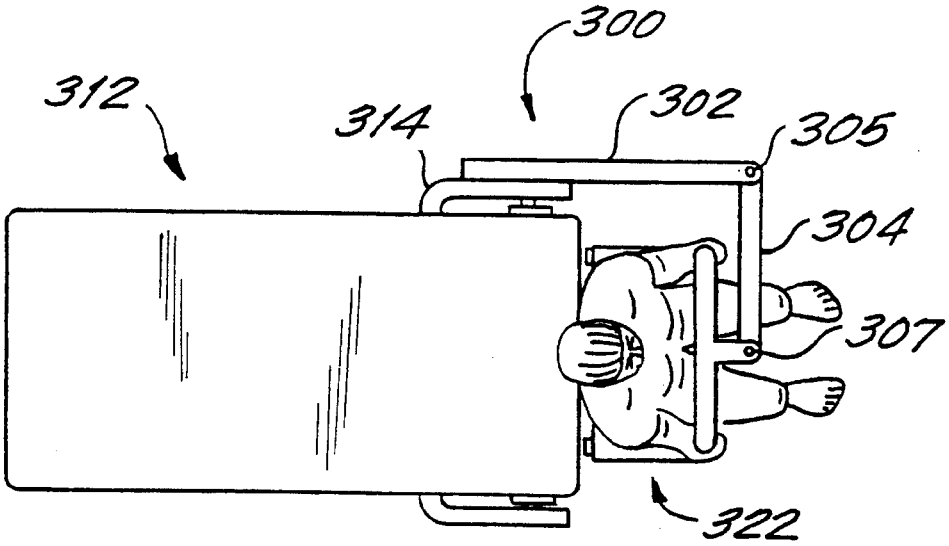
FIGS. 19–21 are top plan views of another patient transfer system constructed in accordance with a preferred embodiment of the subject invention which includes a double jointed transfer linkage for moving the transfer seat assembly to an adjacent wheelchair.
Figure 20:
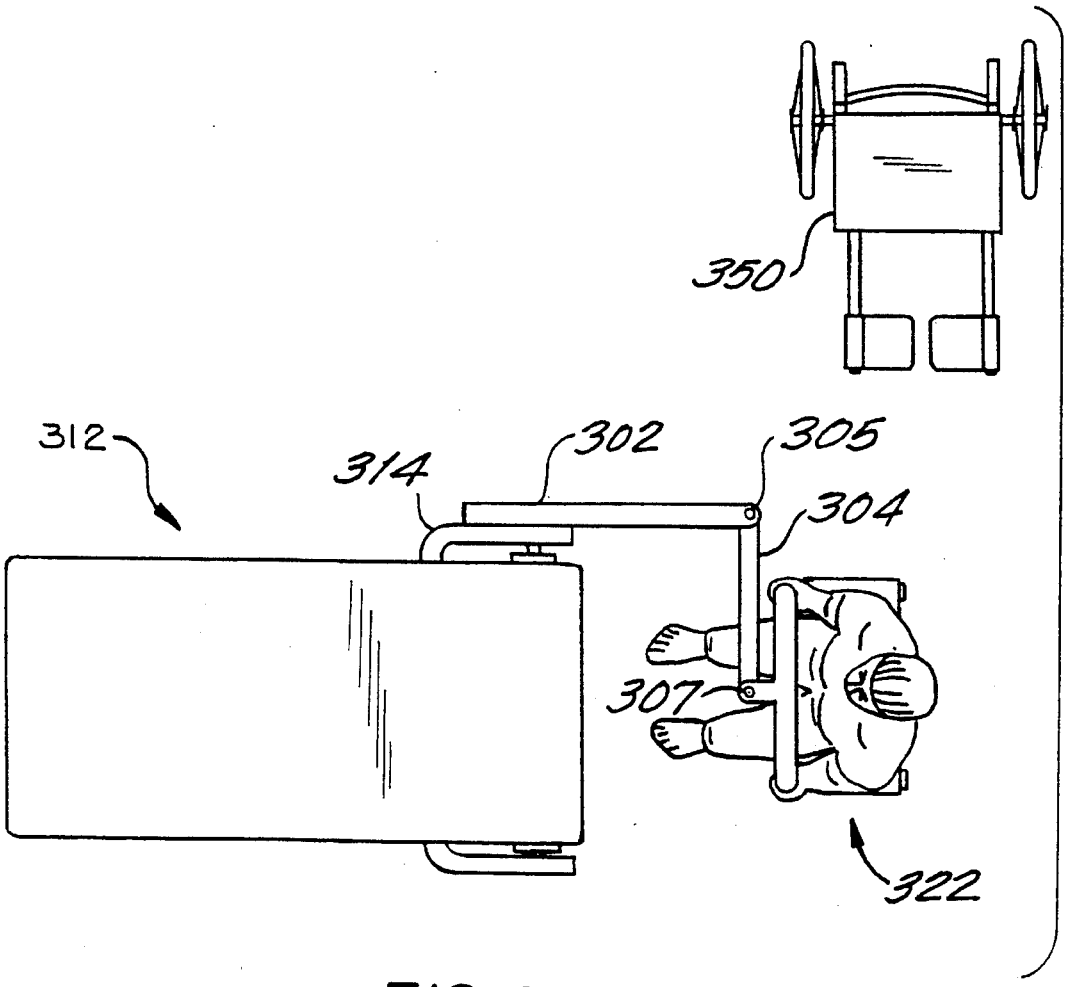
Figure 21:
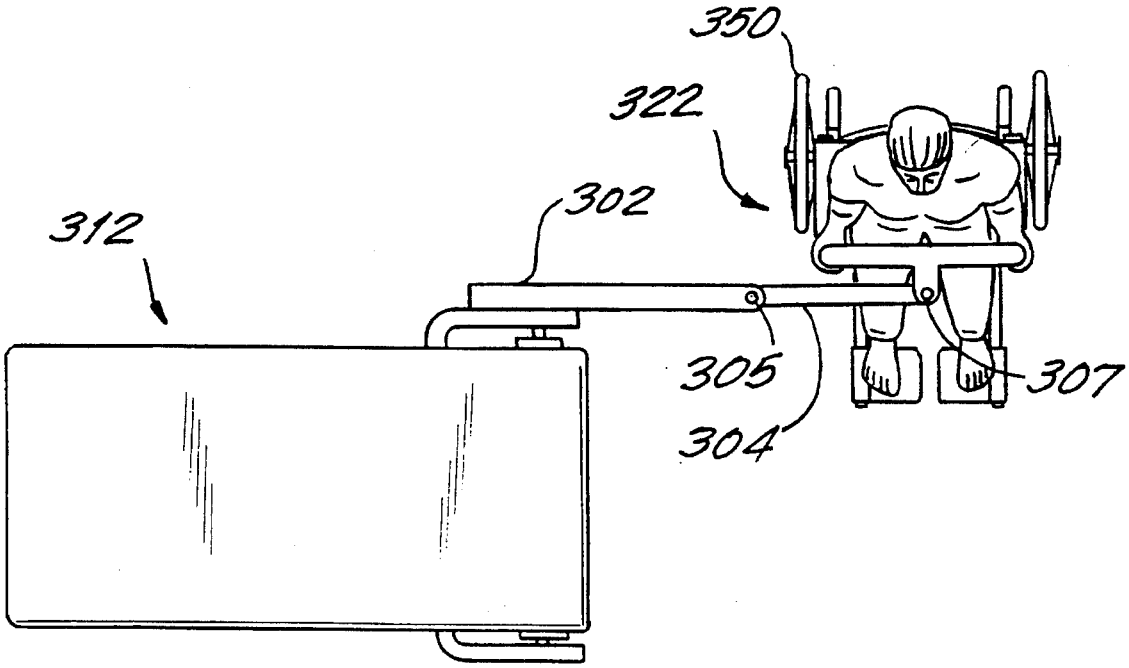

Referring now to FIGS. 19–21, there is illustrated a double jointed articulating suspension linkage assembly 300 which is constructed in accordance with a preferred embodiment of the subject invention and is adapted to move a transfer seat assembly 322 from a position adjacent the foot of hospital bed 312 to a location remote therefrom. In particular, linkage assembly 300 includes a first link arm 302 which is directly connected to bed frame 314 and a second link arm 304 which is connected to the first link arm 302 at joint 305. Transfer seat assembly 322 is pivotably mounted to the second link arm 304 at a second joint 307. In use, the linkage assembly 300 serves to orient the transfer seat assembly 322 in a multiplicity of positions to facilitate the convenient transfer of the patient to a wheelchair 350, as illustrated, for example in FIGS. 20 and 21.

Figure 22:
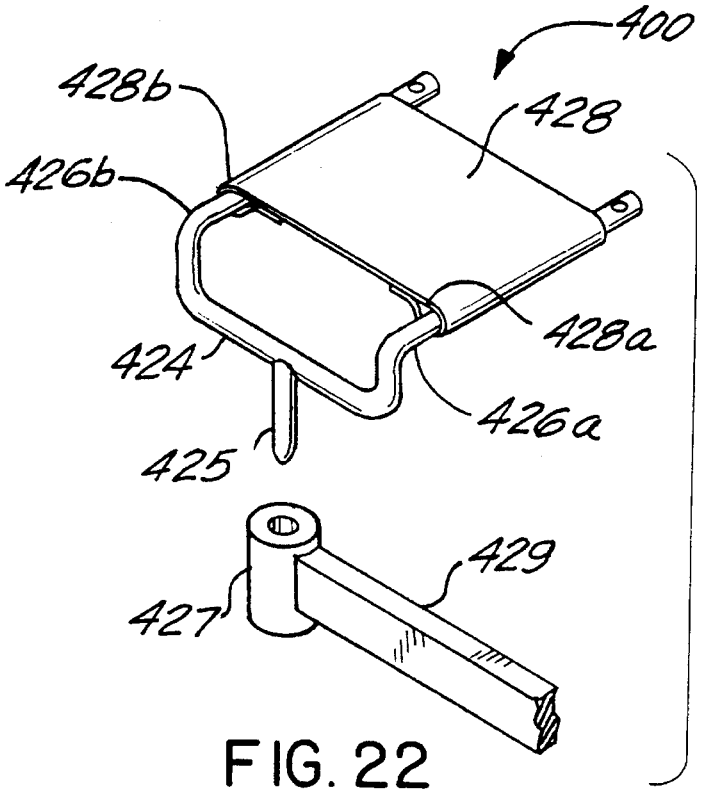
FIG. 22 is a perspective view of another transfer seat constructed in accordance with a preferred embodiment of the subject invention which includes detachable coupling for mounting the transfer seat to a transfer link.

Referring to FIG. 22, there is illustrated another transfer seat assembly which is constructed in accordance with a preferred embodiment of the subject invention and designated generally by reference numeral 400. Transfer seat assembly 400 includes a frame 424 having a pair of parallel support legs 426*a* and 426*b* which are dimensioned and configured for releasable reception within a pair of correspondingly dimensioned and configured side pockets 428*a* and 428*b* formed in the seating surface 428. Frame 424 also includes a downwardly extending pivot post 425 which is configured to engage a pivot coupling 427 formed on a transfer seat assembly link member 429. The pivot coupling 427 enables free rotational movement of the transfer seat assembly 400 to further enhance the range of operability of the patient transfer system of the subject invention. When the support member 429 is lowered to place the seat on a wheelchair or other support, the support member can be disengaged from the seat frame by further lowering.

Figure 23:
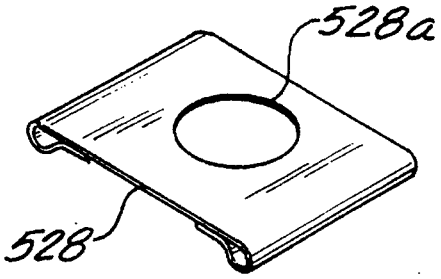
FIG. 23 is a top plan view of a seating surface for the transfer seat assembly of the subject invention which includes an aperture for facilitating direct use of bathroom facilities.

FIG. 23 shows a commode seating surface 528 with an opening 528*a* for use over a toilet.

Figure 24:
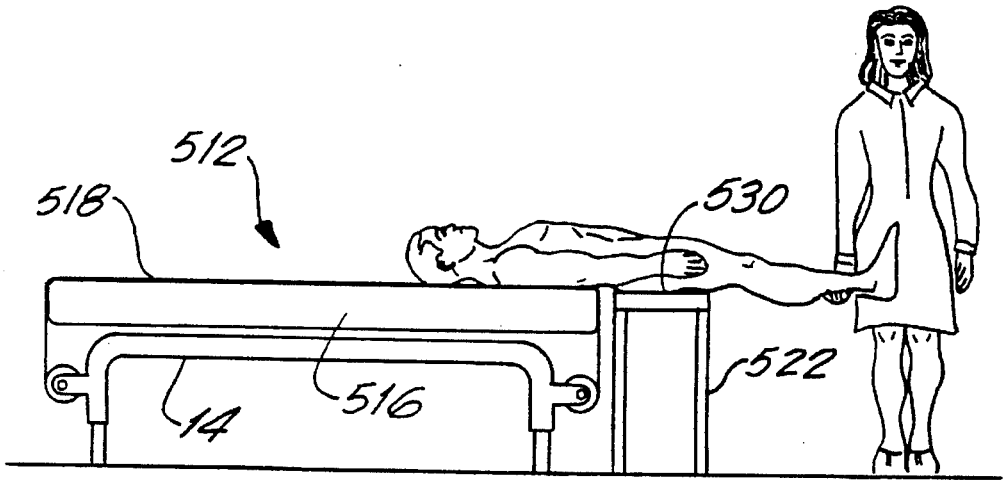
FIG. 24 is a side elevation view of an arrangement for transferring a patient to a stool.

Another preferred embodiment of the subject invention using a stool or bench in combination with a bed and designated generally by reference number 500, is illustrated in FIG. 24. A stool or bench 522, which preferably has a slippery or slidable top surface for patient sliding, is positioned at the foot end of the bed 512, to which the stool may be securely fastened by a latch, not shown. The patient can be carried onto the stool 522 by the conveyor sheet 518 as the patient's legs are supported by an attendant, and the patient can be lifted to a seated position by raising at least part of the mattress 516, in the same manner as illustrated in FIG. 5. Alternatively a leg rest which can be raised may bre provided on the stool, as on many wheelchairs and reclining chairs, to reduce the effort required from the attendant.

Figure 25:
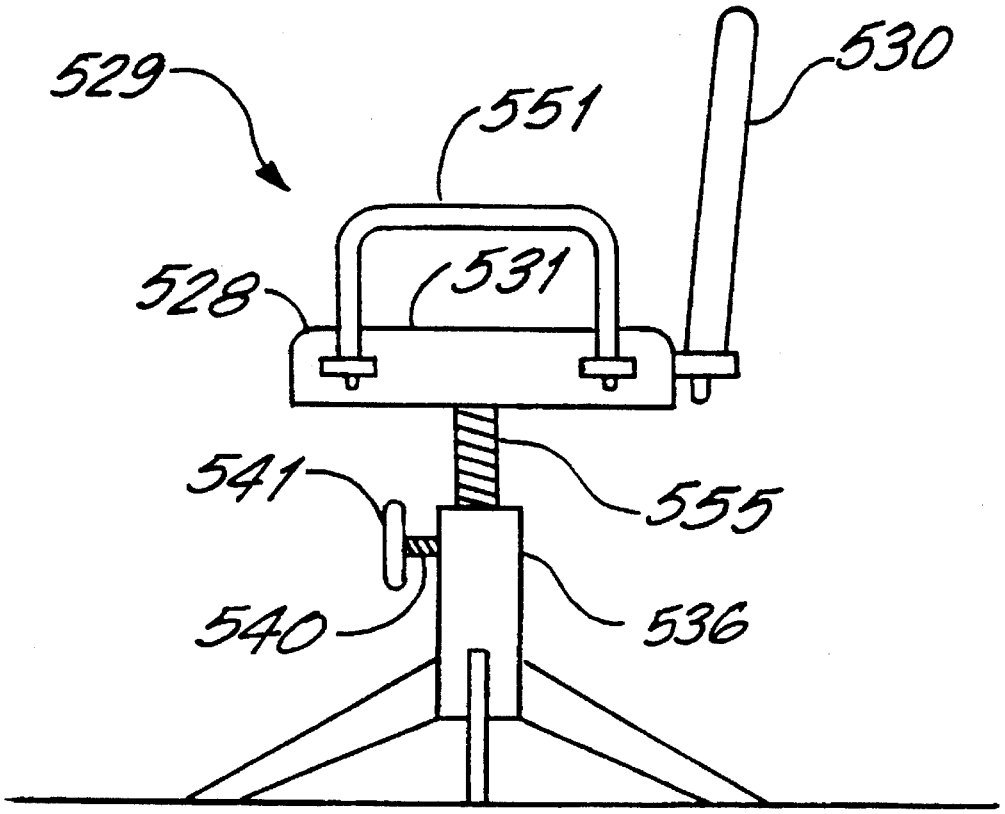
FIG. 25 is a side elevation view of another stool which can be used in the arrangement of FIG. 24 and which is adjustable for subsequent transfer to a wheelchair.

FIG. 25 shows an alternative stool 529 which can be used in place of the stool 522 in FIG. 25. Stool 529 has a seat 528 with a slippery or slidable top surface 531 a removable backrest 530 and removable arm rests 551. The seat 528 is mounted on a shaft 555 which is rotatably supported by a base 536. The seat may be locked in any position by rotating the knob 541 attached to threaded bolt 540 which can thereby be tightened against the shaft 555 to lock it from rotating. The shaft 555 may be threaded and may be supported in a threaded hole in the base 536, so that by rotating the seat 539 the height of the seat may be adjusted in accordance with the height of a wheelchair. A raisable leg rest can also be provided on this stool to reduce the effort required from the attendant.

Although the patient transfer system of the subject invention has been described with respect to a preferred embodiment, it will be readily apparent to those having ordinary skill in the art to which it appertains that changes and modifications may be made thereto without departing from the spirit or scope of the subject invention as defined by the appended claims.

What is claimed is:

1. A patient transfer seat system to transfer a patient from a bed to a location remote therefrom comprising:

a) a seat assembly having a frame portion and a removable seating portion supported by said frame; and b) a bed having a movable sheet for moving the patient onto the seat assembly, and lifting means for raising the patient to a sitting position on the seat assembly.

2. A patient transfer seat system as recited in claim 1, wherein said frame portion includes a pair of parallel support legs and said seating portion includes a pair of parallel pockets for reception of said parallel support legs.

3. A patient transfer seat system as recited in claim 1, further comprising a detachable backrest portion operatively associated with said frame portion.

4. A patient transfer seat system as recited in claim 1, wherein said frame portion is pivotably connected to said bed.

5. A patient transfer seat system as recited in claim 1, wherein said frame portion is pivotably mounted to at least one suspension arm which is pivotably connected to said bed.

6. A patient transfer seat system as recited in claim 1, wherein said frame portion is pivotably mounted to a multi-link suspension system which is pivotably connected to said bed.

7. A patient transfer seat system as recited in claim 1, wherein said frame portion is supported on an independent transport vehicle.

8. A patient transfer seat system as recited in claim 1, wherein said frame portion is detachably mounted to said bed.

9. A patient transfer seat system as recited in claim 1, wherein said seating portion has an opening defined in a seating portion thereof.

10. A transfer seat system to transfer a patient from a bed to a location remote therefrom comprising:

a) a seat assembly having a frame portion including a pair of parallel support legs and a removable seating portion including a pair of parallel pockets for receiving said parallel support legs; and b) a bed having a movable sheet for moving the patient onto the seat assembly, and lifting means for raising the patient to a sitting position on the seat assembly.

11. A transfer seat system as recited in claim 10, wherein the seat assembly further comprises a detachable backrest portion operatively associated with said frame portion.

12. A transfer seat system as recited in claim 10, wherein said seating portion has an opening defined in a seating portion thereof.

13. A method of transferring a patient from a reclined position upon a bed having a transfer sheet to a seated position remote from said bed upon a transfer seat assembly operatively associated with said bed, said transfer seat assembly including a frame portion and a removable seating portion, said method comprising the steps of:

a) conveying the patient in a reclined position at least partially onto said transfer seat assembly by moving the transfer sheet;

b) raising the patient into a seated position on said transfer seat assembly;

c) moving said transfer seat assembly toward a supporting surface remote from said bed;

d) transferring said transfer seat assembly onto said supporting surface; and e) removing said frame portion of said transfer seat assembly from said seating portion thereof.

14. A method according to claim 13, further comprising supporting the patient's legs during said step of conveying the patient onto said transfer seat assembly.

15. A method according to claim 14, wherein said step of supporting the patients legs further comprises providing a support platform adjacent said transfer seat assembly.

16. A method according to claim 13, wherein said step of moving said transfer seat assembly comprises pivoting said transfer seat assembly relative to said bed upon a suspension linkage.

17. A method according to claim 13, wherein said step of moving said transfer seat assembly comprises transporting said transfer seat assembly upon an independent transport vehicle.

18. A method according to claim 13, wherein said step of moving said transfer seat assembly toward a supporting surface includes elevating the transfer seat assembly.

19. A method according to claim 18, wherein said step of supporting the patient's legs further comprises providing a leg support platform adjacent said transfer seat assembly.

20. A method according to claim 18, wherein said step of moving said transfer seat assembly toward a supporting surface comprises transporting said transfer seat assembly upon an independent transport vehicle.

21. A method according to claim 18, wherein said step of moving said transfer seat assembly toward a supporting surface comprises pivoting said transfer seat assembly relative to said bed.

22. A method according to claim 13, wherein said step of transferring said transfer seat assembly onto said supporting surface includes lowering said transfer seat assembly onto said supporting surface.

23. A method of transferring a patient from a reclined position upon a bed having a mattress to supporting surface remote from said bed by means of a transfer seat assembly operatively associated with said bed and including a frame portion and a removable seating portion, said method comprising the steps of:

a) conveying the patient in a reclined position at least partially onto said transfer seat assembly while supporting the patient's legs;

b) lifting at least a portion of said mattress to raise the patient from said reclined position into a seated position on said transfer seat assembly;

c) moving said transfer seat assembly toward said supporting surface remote from said bed;

d) transferring said transfer seat assembly onto said supporting surface; and e) removing said frame portion of said transfer seat assembly from said seating portion thereof.

24. A patient transfer arrangement comprising a bed and a seat positioned at the end of the bed; the bed having a movable sheet for moving the patient across the bed and onto the seat; lifting means for raising the patient to a sitting position on the seat; and transfer means on the seat to assist an attendant in transferring the patient from the seat to a wheelchair.

25. A patient transfer arrangement as described in claim 24 wherein said transfer means includes a slippery or slidable top surface on said seat to facilitate the patient's sliding during transfer.

26. A patient transfer arrangement as described in claim 24 wherein said transfer means includes a removable backrest and means for rotating said seat and locking it in a position.

27. A patient transfer arrangement as described in claim 24 including means for adjusting the height of the seat.

* * * * *